US007191932B2

(12) United States Patent
Fobbe et al.

(10) Patent No.: US 7,191,932 B2
(45) Date of Patent: Mar. 20, 2007

(54) DEVICE AND METHOD FOR THE AUTOMATIC HANDOVER OF GOODS

(75) Inventors: Aldo Hermann Fobbe, Gelsenkirchen (DE); Jesper Okkels, Marl (DE)

(73) Assignee: Roland Wubbe, Marl (DE), part interest ( * ) Notice: Subject to any disclaimer, the term of this patent is extended or adjusted under 35 U.S.C. 154(b) by 53 days.

(21) Appl. No.: 10/470,217

(22) PCT Filed: Jan. 25, 2002

(86) PCT No.: PCT/EP02/00757

§ 371 (c)(1),
(2), (4) Date: Feb. 12, 2004

(87) PCT Pub. No.: WO02/058519

PCT Pub. Date: Aug. 1, 2002

(65) Prior Publication Data

US 2004/0133304 A1 Jul. 8, 2004

(30) Foreign Application Priority Data

Jan. 27, 2001 (DE) ..... 101 03 756

(51) Int. Cl.
*A47G 29/12* (2006.01)

(52) U.S. Cl. ..... 232/19; 232/45; 232/39; 340/5.73; 340/569; 248/146

(58) Field of Classification Search ..... 232/45, 232/17, 19, 39; 340/5.73, 568.1, 569; 248/146, 248/154, 156
See application file for complete search history.

(56) References Cited

U.S. PATENT DOCUMENTS

| | | | | |
|---|---|---|---|---|
| 2,023,826 | A | 12/1935 | Buskirk | |
| 4,894,717 | A | 1/1990 | Komei | |
| 5,774,053 | A * | 6/1998 | Porter | 340/568.1 |
| 5,979,750 | A * | 11/1999 | Kindell | 232/19 |
| 6,300,873 | B1 * | 10/2001 | Kucharczyk et al. | 340/568.1 |
| 6,323,782 | B1 * | 11/2001 | Stephens et al. | 340/10.31 |
| 6,715,669 | B2 * | 4/2004 | Hara | 232/45 |
| 6,967,575 | B1 * | 11/2005 | Dohrmann et al. | 340/568.1 |

FOREIGN PATENT DOCUMENTS

| | | |
|---|---|---|
| DE | 200 12 633 U1 | 10/2000 |
| FR | 2 615 895 A | 12/1988 |
| GB | 2 366 644 A | 3/2002 |

(Continued)

*Primary Examiner*—William L. Miller
(74) *Attorney, Agent, or Firm*—Fay Sharpe LLP

(57) ABSTRACT

An apparatus is provided for receiving ordered products and/or making products available for pickup. The apparatus has a lockable container for the products with at least an input device and a controller with a memory element. The method employs this reception/provision apparatus. A control unit including at least input device, controller and memory element is positioned with container in front of the user's residence or place of business for an expected delivery/pickup. After a completed ordering process, the obtained order information is input by the user into memory element of reception/provision apparatus to put reception/provision apparatus in a state of readiness. The transportable reception/provision apparatus is positioned in front of the user's residence or place of business for the expected delivery or pickup of product.

26 Claims, 6 Drawing Sheets

FOREIGN PATENT DOCUMENTS

| | | | |
|---|---|---|---|
| JP | 11018916 | | 1/1999 |
| WO | WO 00/57759 | | 10/2000 |
| WO | WO 00/76378 | A2 | 12/2000 |
| WO | WO 01/00069 | A2 | 1/2001 |
| WO | WO 01/51744 | A2 | 7/2001 |
| WO | WO 01/80695 | A2 | 11/2001 |
| WO | WO 02/15758 | A2 | 2/2002 |

* cited by examiner

DEVICE AND METHOD FOR THE AUTOMATIC HANDOVER OF GOODS

The invention pertains to an apparatus for receiving ordered products and/or making products available for pickup without personal transfer to or by the user. The invention also pertains to a method for receiving ordered products and/or making products available for pickup without personal transfer to or by the user, making use of a reception/provision apparatus.

BACKGROUND OF THE INVENTION

It has by now become common to order books, CDs, foods or other products by telephone or from the Internet and have them delivered to one's home or place of business. In many cases, these products are delivered and the receivers (users) are not present to take possession of the products. For this case, the only recourse is delivery to neighbors or other persons, with the associated uncertainties or for the deliverer to undertake another delivery attempt. The return shipping of products is often necessary due to complaints or delivery mistakes, in which case the sender must wait for someone to pick up the package or take the routes already mentioned for receipt of products. Overcoming the so-called "last mile," the above-described path from the deliverer to the recipient of the product or from the sender to the person picking the product up, can thus result in considerable logistical expense and costs resulting therefrom. To enable the delivery of product parcels even in the absence of the recipient, automatic reception apparatuses for products have been developed, representing a kind of interface between deliverer and recipient.

An automatic reception apparatus, which is intended to allow the delivery of products ordered by telephone, via the Internet or by e-mail to a recipient, even if the latter is absent, is already known from International Publication No. WO 00/57759. The most important part of this system is a standardized transport container. It is tub-shaped and can be closed with a lid. The container is preferably manufactured from plastic. Its walls can be thermally insulated, so that frozen products or products that must be kept cool can be accommodated therein. The container is also constructed to be stackable or foldable with the lid removed. Coded information in the form of magnetic strips or bar codes is placed on the outside of the container in a designated position. The crucial special feature of this container is that its outer dimensions and the positions for placing magnetic information on the outside of the container must be fitted exactly to the dimensions of the reception apparatuses that must be furnished in the residential buildings to receive containers, or vice versa.

This known reception apparatus has a cutout, of a size corresponding approximately to the outside dimensions of the container, in the outside wall of the recipient's house. This opening can be closed off by an outside, pivotably suspended flap. The flap can be locked to prevent intrusion of people, animals or unwanted objects into an intermediate space adjoining the flap. In the area of the opening and outside in front of the flap, sensors are arranged, by means of which the coded information present on the container can be read. In the case when the read information, after optional deciphering, agrees with information on an expected delivery of goods, the flap opens and the container must be inserted sufficiently far into the box-like intermediate space that additional coded information placed on the front end of the box can be recognized by a sensor arranged on the back wall of the box-like intermediate space. At this point, and if additional sensors arranged in the intermediate space report, for instance, that the container has standard dimensions as well as the usual weight and the usual temperature properties, the outer flap closes. The back wall of the box-like intermediate space is constructed as an additional inner flap which is not unlocked until the outer flap is closed and locked after a container has been inserted. Now the delivered container can be removed manually or automatically, for instance, by a conveyer belt, and placed on a storage shelf. With an automatic set-up and sufficient space, it is thus even possible to receive several containers in succession.

The International Publication No. WO 00/57759 also describes equipping the reception apparatus, not with an outer flap, a box-like intermediate space and an inner flap, but only with an outer flap that is adjoined by the storage shelf. In this case, however, the sensors that detect, for instance, the weight, dimensions and temperature of the container must be arranged in front of the outer flap. Since only a single flap that constitutes a point of entry into a residential building is thus provided, it must be designed to be particularly break-in-resistant. Alternatively, it is designed to be possible to place the box-like intermediate space outside the residential building, in which case only the rear flap is positioned in the outside wall of the building. Beneath the outer flap, it is also possible for an additional flap to be provided, via which an empty container is returned when a new package is received, because the containers must always be returned to the delivery circuit.

To trigger the sensors that bring about an opening of the outer flap, WO 00/57759 provides for the use of an order code by the computer that controls the reception apparatus at home, following an order for the product via telephone, Internet or e-mail. This order code also occurs in encrypted form in the coded information of the standardized container and, when a previously ordered product is delivered, it is read by the sensors and recognized by the computer. which then brings about the opening of the outer flap. There is thus no necessity that the order code be known to the shipping company. It suffices to pass only details regarding the recipient such as name and address to this company.

The previously described system for automatic reception of ordered product shipments proves disadvantageous, however. First, expensive sensors and locks must be provided to prevent the intrusion of people, animals and other objects into the box-like intermediate space behind the outer flap, and thus into the house in question. To enhance security, outer packages for the products in the form of standardized shipping containers are used, of which the outer dimensions are fitted to the clear width of the opening in the house wall and of the intermediate space behind it; they thus fill up the intermediate space. These extra transport containers represent an additional freight weight that must be carried by the delivery person. Since the entire reception apparatus is keyed to the use of standardized containers, a certain number of such containers must be in circulation for such a system to be introduced, which entails correspondingly high costs. The return of the empty containers also proves very expensive, since they require additional logistical management. The use of this reception apparatus for multi-family houses is problematic, because, behind the flap, it is necessary to provide a storage shelf that permits only the authorized recipient to have access to the delivered product containers.

FR 2 615 895 A, even older than the above, also describes a reception box installed in a house wall, which, with two doors, can be used in the manner of a transfer channel for freight-paid product deliveries. The person delivering the product opens the outer door, like a safe, by means of numerical code stored in a door-opening device; it is selected from a number of possibilities and given to him by the customer (recipient). For confirmation of delivery of the product, the delivery person uses a marking unit arranged in the interior of the box, which provides a receipt for the product placed in the reception with the acquired numerical code. When the outer door is reclosed, the numerical code that was just used is blocked so that the delivery person can no longer open the door to cancel the confirmed product transfer unlawfully, for instance. Thus, this reception box presents a possibility of assuring the transfer of ownership of the delivered product without personal acceptance by the recipient. This method presents the delivery person with a considerable logistical problem simply because different customers could give a delivery person the same code, thereby creating confusion with delivery of the product. This method is not suitable for a larger group of recipients and delivery people and an increasing number of "recipient-free" freight-paid deliveries.

U.S. Pat. No. 4,894,717 describes a reception station for large buildings, with a plurality of reception boxes serving for product transfer to absent recipients. The delivery person selects a vacant box, which he opens using a delivery person's code. This system is suited only to large buildings with the appropriate infrastructure. Rapid proliferation of the system, especially for the large number of customers in private houses, is not possible.

JP-A-11018916 and especially U.S. Pat. No. 5,774,053 describe a reception box in the outer wall of a building having a communications unit for reporting product reception or product pickup. Code numbers for the various suppliers are stored in a memory of the communications unit; for each supplier, additional codes for various recipients can be provided. A telecommunications network connects the reception box to a computer in the residence of the purchaser/recipient and a supplier's computer. Code numbers for various purchasers/recipients are also stored in the communications unit so that communication via the Internet for making transactions between the purchaser/recipient, the seller/delivery person and the reception box is possible. In this case, the purchaser issues a code for the order. The disadvantage of this system are, among others, that (i) only a selected group of suppliers obtains access to the system; (ii) code number management by the customers causes great expense to the supplier (who, after all, would like to supply as many different customers as possible); and (iii) rapid proliferation of the system, i.e., the possibility of use by a great many participants, is not possible, since only a few houses/buildings offer the possibility of permanent installation for reception boxes connected to a data network.

THE PRESENT INVENTION

Proceeding from this prior art, especially from WO 00/57759, the present invention is based on the problem of creating an economical apparatus and an economical method for receiving products and/or making products available for pickup without personal transfer to or by the user which can get by without additional shipping containers serving, for instance, as extra packaging and, in particular, without standardized shipping containers, and which can be flexibly adapted to different user situations. Easy usability and slight construction measures on the residences or businesses of the users are also desirable. Thereby a rapid proliferation of the system should be created, with as many users in the system as possible. Another problem is to create a delivery system that permits access to an unlimited number of participants in e-commerce.

In the apparatus for receiving ordered products and/or making products available for pickup without personal transfer to or by the user according to the invention, at least the memory element or at least a part of the control unit of the reception/provision apparatus, consisting of the controller, the memory element and optional input means, is—physically—transportable. For an expected delivery or pickup, the transportable part of the reception/provision apparatus is positioned in front of the residence or place of business, where optionally a part of the reception/provision apparatus not provided for being transported is already located. In the first embodiment, the control unit and the container constitute a permanently joined constructive unit. If the container for the respective product transfer can be positioned in front of or alongside the residence or place of business, the reception/provision apparatus can be used immediately, usually without major structural modifications of the building of residence or place of business in question.

According to an alternative embodiment, the reception/provision apparatus has at least one (internal) interface in a form such that at least the memory element can be removed from the container. This applies even if the reception/provision apparatus as a whole is (designed to be) transportable, in order to put the container into place only when needed and at a site in the user's residence or place of business that is appropriate and accessible to the delivery person.

The interface can also be provided such that the entire control unit, or at least a part of the control unit containing the memory element, can be removed from the container. Thereby it becomes possible for the user to insert the "intelligent" part of the reception/provision apparatus, which has a certain financial value and is in a certain sense more sensitive than the container itself or simple mechanical operating elements, into various containers, more particularly, into containers of different capacities or different length-width-height ratios. The user can thus couple an entire set of different, quite economical containers by a simple connection to the "intelligent" part which he need only buy once, to be able to adapt intelligently to various deliveries. An additional advantage of such internal interfaces shows its value when one stationary container (or container system) in, for instance, a hotel or residential facility (apartment house) can selectively be used for a great variety of users (hotel guests or apartment residents). Then, an initially "non-intelligent" container becomes the personal reception and provision apparatus for a given user by insertion of the "intelligent heart"; because of the "intelligent heart" it is also equipped with container code or box code and is thus unambiguously identifiable for the delivery person.

Another embodiment provides that an externally accessible, lockable room such as a garage be used as reception/provision apparatus or as the container for the latter. The locking device is then provided on the garage door, for instance. The control unit is provided there, or at a suitable site nearby in the garage. The "intelligent" heart can be used as described above or below.

The memory element that can be utilized at such an interface to turn the "non-intelligent" reception/provision apparatus into an "intelligent" one, can be designed and equipped in various ways, for instance, as a chip card containing a memory and possibly a processor of its own and, in certain circumstances, a battery as well. Such chip cards are used in banking transactions and mobile telephones, among other fields. They need only be loadable with the order information. After insertion of this chip card, the reception/provision apparatus is ready for a secure, person-free product transfer, which is legally and financially protected. To open the container, the user can employ, for instance, a second or duplicate card.

A different memory element can be a simple printed label printed out by the printer of the user's personal computer system based on order code generation by and communication from the central fulfillment computer to the user. For this particularly economical embodiment, the label can be inserted behind a window in the container to make the reception/provision apparatus "intelligent" in that sense. In this case, the shipper (and not every user) must be equipped with an input means such as a laser scanner. In this case, for instance, the delivery person's laser scanner can compare the bar code on the product (delivery information) with the bar code in the container (order information). If the correct correlation has been identified, the laser scanner can transmit a door-opening signal to the container.

In all these embodiments, there need not be a permanent data link between the user's Internet connection and his product reception apparatus. Instead, physical transport of at least the memory element between the user's personal computer and the installation site of the product reception container is generally necessary. Without the memory element, the reception/provision apparatus remains "non-intelligent" so that the only damage possible from destruction, vandalism or the like renders only the quite inexpensive reception apparatus unusable. Intrusion into a data line by, for instance, the built-in laser scanner can be ruled out with certainty.

If, according to a second embodiment, at least the memory element is transportable, the order information can be input even more conveniently, in the premises of the residence or place of business. Since the product is shipped in the usual packing, it is by no means necessary first to bring standardized containers into circulation to establish such a delivery system.

Advantageously, the container has fastening elements, preferably at the back end, that consist essentially of locking elements, openings and retaining elements, by means of which the container is fastened to a stationary component in front of or on the outside wall of the residence or place of business of the recipient. By means of the locking elements, the reception apparatus can be easily protected against theft with the door open. The stationary component can be constructed particularly easily as a post anchored in the ground from which the container is suspended. Retaining elements for the locking elements and the openings in the container are arranged on the stationary component. In this way, the investment costs for the necessary construction measures can be kept quite low.

The container advantageously has a door that can be locked and unlocked by means of a door lock. In this case, the door lock is operated electrically by a controller. In the preferred embodiment, it is possible to forgo an additional lock on the reception/provision apparatus alongside the door lock, if the locking elements for mounting the container on and removing it from the [stationary] component can be locked from the inside of the container, because these are no longer accessible from the outside after the door has been closed.

The controller can be provided with an interface, preferably a USB interface so as to be able to input the order information particularly easily from a PC into the memory element of the controller.

Since the reception/provision apparatus is transportable and the mounting has only simple mechanical parts, a power supply, preferably a battery, supplying the controller and the input unit is arranged in the container, in case the control unit is a component of the container.

For easy transport of the reception/provision apparatus between the rooms in the residence or place of business and the component for mounting it, a carrying element, preferably a handle or at least a recessed grip, is arranged on the outside of the container.

In the preferred embodiment, the input device is constructed as a scanner, preferably a laser scanner, for reading delivery information arranged on the product, preferably in the form of a bar code.

According to the invention, a method is also provided for the reception of ordered products and/or making available products for pickup without personal transfer of the product to or by the user, making use of a reception/provision apparatus. This is distinguished in that, after an ordering process has been completed, order information agreed upon for putting the reception/provision apparatus in a state of readiness is input by the user into the memory element of the reception/provision apparatus and the transportable reception/provision apparatus is positioned in front of the user's residence or place of business for the expected delivery or pickup of the product. Alternatively, the user inserts the transportable memory element or a transportable part of the control unit into the container positioned in front of the user's residence or place of business or into the part of the control unit present there. Thus it is particularly convenient that input of the order information is performed in the rooms of the user's residence or place of business and that the transportable part of the reception/provision apparatus need only be mounted in front of the residence or place of business when necessary. The order information can thus be recorded directly from a PC into the reception/provision apparatus or its memory element.

To open the reception/provision apparatus at the user's residence or place of business, coded delivery information must be input via the input means by the delivery person; it is preferably issued worldwide only for this individual delivery process, so that an erroneous delivery or pickup is out of the question, since then the door of the reception/provision apparatus cannot be opened. After the product is delivered by the delivery person or is picked up, the transportable part of the reception/provision apparatus, optionally, together with the delivered product, is taken back into the rooms of the user's residence or place of business and the product is subsequently removed if it was not already picked up.

A particularly preferred embodiment of the invention results from claim 14, which represents a solution of independent inventive significance, independently of the type of data transfer for the order information between the user's PC and the reception box. Here the user transmits his product order by means of data communications, e.g., the Internet, using as the only intermediary a central fulfillment computer which first performs all the tests such as those for the presence of an approved reception box, for credit-worthiness and for authorization of the user, the supplier and the delivery company to access the system. If desired, the central fulfillment computer can also support cashless payment transactions. The central fulfillment computer generates a unique code for this specific order fulfillment and communicates it to those involved in the transaction as order information, delivery information or pickup information. This identcode is binding and unmistakable for everyone involved in this order fulfillment, the user having the responsibility to see to it that the identcode is input into the memory element of the reception/provision apparatus. This input can be made by the user via a short-range, in particular, non-contact data transfer means, for instance, with the aid of a Bluetooth or IR interface of a mobile telephone or a notebook the user carries with him to "cock" his reception box. Another form of data transfer from the user's personal computer to his product reception box can be accomplished by modulating the identcode, i.e., the order information via a data coupler onto the power network of the house, which also supplies the product reception box with power. These modes of transferring the order information to the product receipt box are also very easy to use and secure against an attack on the user's computer on the part of the product reception box.

The above-mentioned components as well as those claimed and described in the embodiments that are to be used according to the invention are not subject to any particular exceptional conditions with regard to their size, designed shape, material selection and technical conception, so that the selection criteria known in the field can be applied without restriction.

Additional details, features and advantages of the object of the invention follow from the subordinate claims as well as the description below of the associated drawings in which, for the sake of example, a preferred embodiment of the reception/provision apparatus according to the invention is illustrated. Shown in the drawings are:

PREFERED EMBODIMENTS

Figure 1:
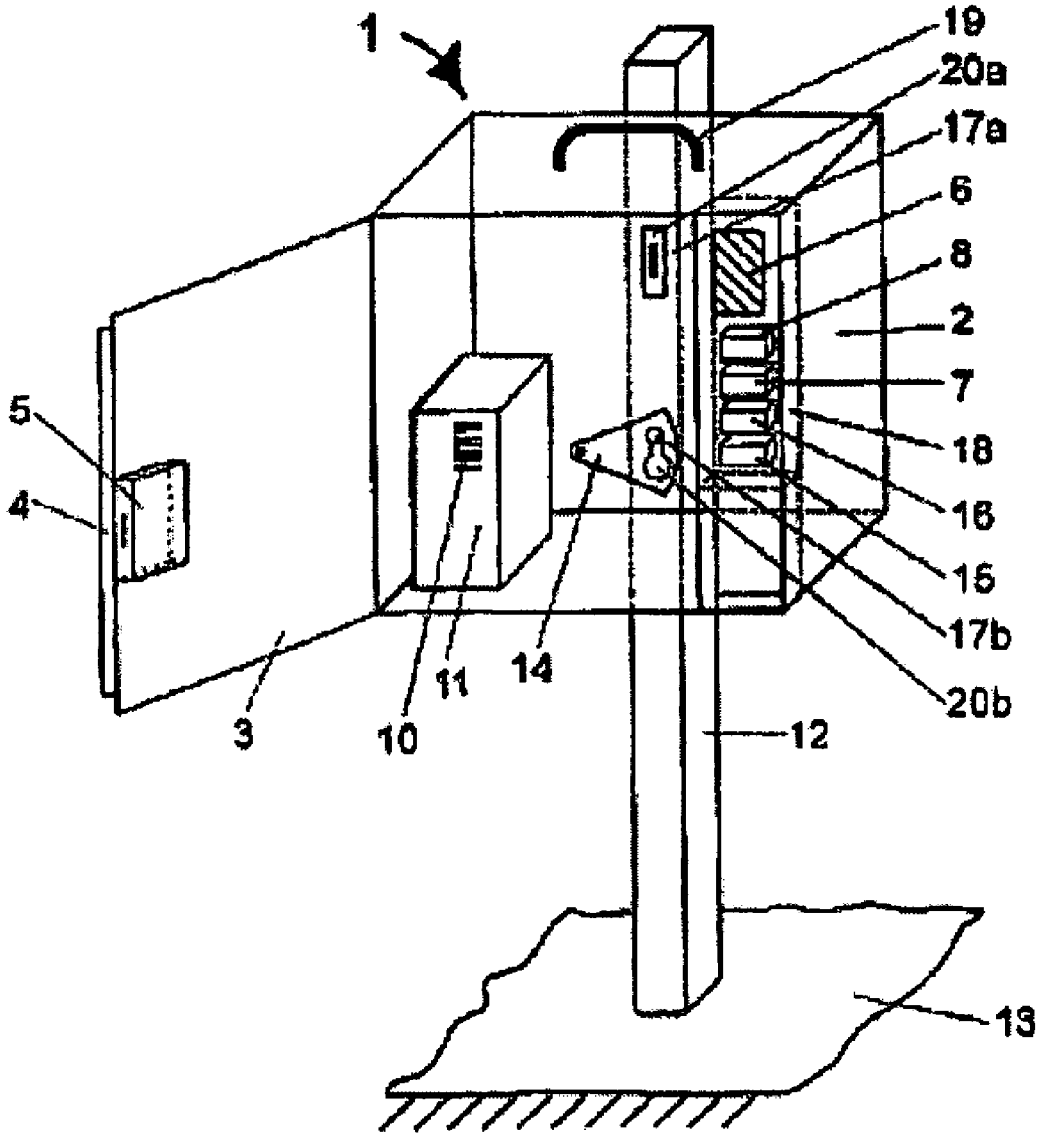
FIG. 1, a perspective view of a reception/provision apparatus according to the invention.

FIG. 1 shows the reception apparatus 1 according to the invention in a perspective view; it consists in essence of a block-shaped container 2 having on its front side a side-hung door 3 with a handle 4. Alternatively or in addition to the one carrying handle 19, the container can also be provided with rollers. To be able to close container 2, a door lock 5 is provided on door 3. This door lock 5 can be electrically operated to unlock door 3. Even in case the electrical actuation fails, it can be provided for the owner of reception apparatus 1 to be able to open the door lock mechanically by means of a key or, in case of failure of power supply 16, which is arranged in the form of a battery in container 2, to be able to connect an external power supply. A power adaptor with a line plug can be provided for this purpose on control unit 8. The electrical actuation of door lock 5 is done by inputting coded delivery/pickup information 10 or a type of user master key into an appropriate input device 6 preferably arranged on the front of container 2 alongside the door. Depending on the type of coded delivery/pickup information, the input device can be constructed as a keypad, a rotary dial, a sensor for light waves (IR, UV waves) or electromechanical waves (sound waves, radio waves, frequency pulses) or as a reader device for data media such as diskettes, CDs, flash ROM, chip cards, punch cards, magnetic cards or bar codes. Input device 6 is preferably constructed as a laser scanner and connected via a controller 7 arranged in the interior of container 2 to door lock 5. This controller 7 has a memory element 8 in which coded order information 9 (FIG. 4) is stored by the user and with which reception/provision apparatus 1 is placed in readiness for a receipt or pickup. This coded order information 9 in memory element 8 matches or is in defined relationship to additional coded delivery/pickup information 10. The latter is known to the delivery or pickup person for an ordered product and/or is preferably mounted on product 11. This coded delivery information 10 on product 11 is preferably in the form of a bar code for a laser scanner or the like. In principle, any type of information medium that can be read by the above-mentioned input means can be used.

The inputting of the coded order information 9 by the user into memory element 8, which puts container 2 in readiness, takes place via an interface 15 associated with controller 7, for example, a USB interface, directly from a conventional personal computer. The inputting of the order information can be done via input device 6 or some other input device. Since a user authentication is/should be performed here, sensors for recognizing a fingerprint or an iris scan could be considered as input means.

Figure 2:
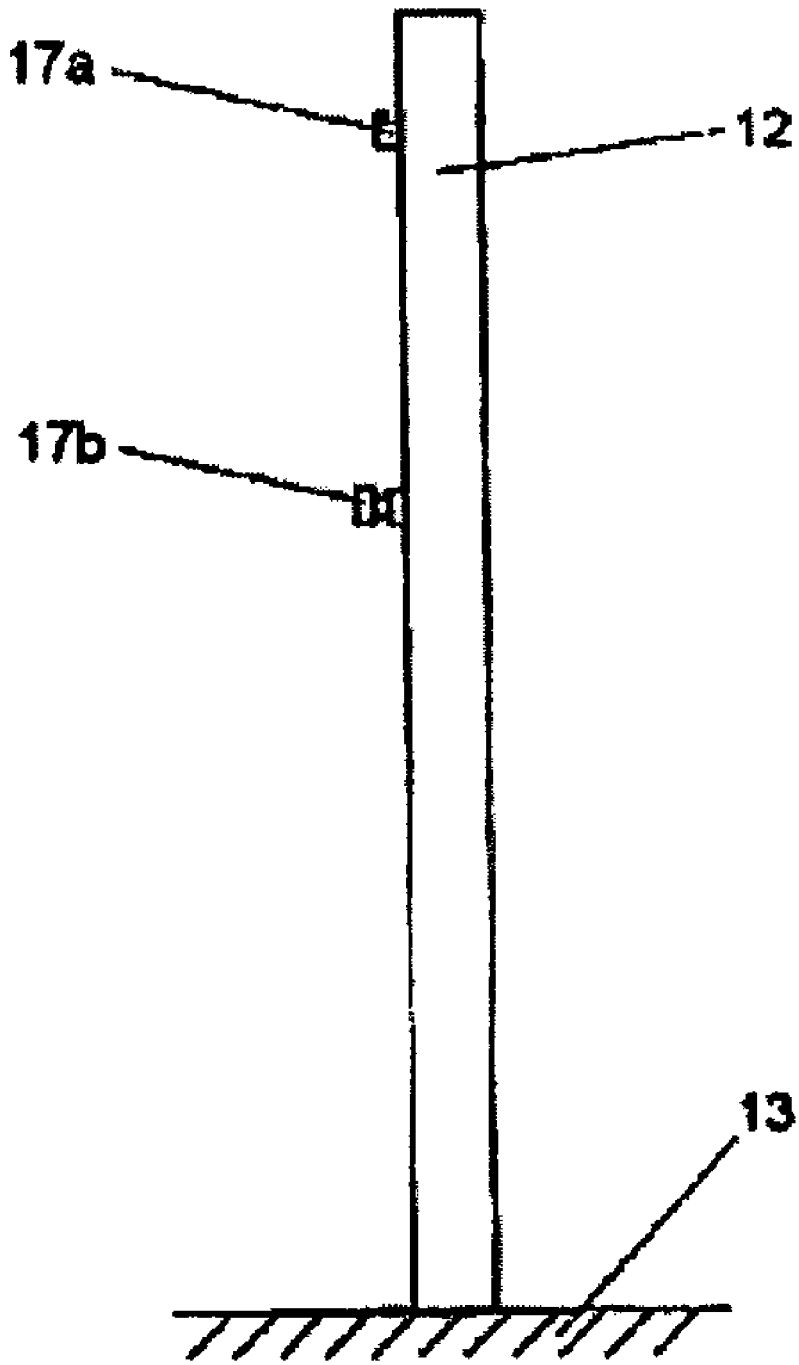
FIG. 2, a side view of a component of the reception/provision apparatus with retaining element according to FIG. 1.

Furthermore, it can be discerned from FIG. 1 in conjunction with FIG. 2, which shows a side view of the mount of FIG. 1, that reception/provision apparatus 1 is arranged, preferably hung, on a construction element 12 that is located at a publicly accessible site in front of the recipient's residence or place of business. In a preferred embodiment, this construction element 12 is constructed simply as a post that is anchored in the ground 13. It is also possible to provide a house wall or other building parts as construction element 12. Container 2 is hung on construction element 12 for receiving ordered products 11 via fastening elements consisting of retaining elements 17*a, b* arranged on construction element 12, of openings 20*a, b* arranged on the rear side of container 2 and of a locking element 14 arranged in container 2 in the area of opening 20*b*. By virtue of locking device 14, which interacts with retaining element 17*b,* container 2 is joined to construction element 12 so as to prevent theft of reception/provision apparatus 1, especially after delivery of product 11, but in a manner that can be released by the user as desired. To fasten container 2 to retaining element 17*a, b* on construction element 12, container 2 is suspended from hook-shaped retaining element 17*a* by its upper opening 20*a*. Then container 2 is pushed onto lower, pin-shaped retaining element 17*b* by its lower opening 20*b* in the back wall. Opening 20*b* surrounds retaining element 17*b* with essentially a form fit. To lock lower retaining element 17*b,* a continuous groove is provided at its free end, into which a plate-like pivot element arranged on the inside of container 2 can be pivoted with an opening in the shape of a keyhole. Retaining elements 17*a,* 17*b* can also simply be provided on the wall of a house.

Furthermore, the material of container 2 can be adapted to the respective environmental and/or usage conditions and is correspondingly manufactured of metallic or synthetic materials. Container 2 also provides sufficient protection against inclement weather conditions for product 11 and control unit 18, which consists essentially of controller 7, memory element 8 and, optionally, input means 6, power supply 17 and interface 15. It is also possible to construct the walls of container 2 to be thermally insulated, so that even temperature-sensitive products can be preserved there for several hours. In front of multi-family houses or places of business with several recipients, several fastening elements or hanger devices can be provided, in order to hang several containers 2. Retaining elements 17*a, b* are designed to be universal so that reception/provision apparatus 1 can be fastened to various pairs of retaining elements 17*a, b*.

Container 2 is preferably of such a size as to be able to accommodate at least one package; more preferably, however, it should be able to accommodate two full shopping bags. Thus, container 2 is sufficiently easy to handle and portable together with product 11. Container 2 can also be equipped with rollers. Different sizes of container 2 can also be provided, depending on the type of received product 11, controller 7, optionally with input means 6, optionally being easily interchangeable between containers 2. For this purpose, controller 7, memory element 8, interface 15 and power supply 16 are collected into a mobile and detachable control unit 18. Thus, it is also possible to leave container 2 outside permanently and attach control unit 18 as needed.

Now that the fundamental structure of reception/provision apparatus 1—referred to as a box for short—has been explained, an ordering and delivery process of a product 11 will be described below on the basis of FIGS. 3*a–c* and 4, which show corresponding flow charts, so as to explain further the functioning of reception/provision apparatus 1 according to the invention—or of a part of the latter containing memory element 8. In the initial situation, reception/provision apparatus 1 or at least the memory element is situated in the rooms of the residence or place of business of the orderer or future recipient. At the beginning of the ordering process, the orderer (user) K1, K2, K3, . . . logs into the selected dealer H1, H2, H3, . . . , possibly via and ISP (Internet service provider), and in the case of a request for or order of a product, communicates its own identification number and that of its box (box code), whereby the personal data of the orderer and the installation site of reception/provision apparatus 1 are available to the supplier in a particularly easy manner. The orderer (user) also communicates its order. At the end of the ordering process, which can also take place via telephone or in writing, but preferably via the Internet or e-mail, orderer K receives order information 9 generated by an interpolated central fulfillment computer ZA (receipt of delivery code). This, preferably encrypted, order information 9 (identcode) is unique and is input by the user of reception apparatus 1 into memory element 8 of controller 7 by, for instance, an interface 15 associated with controller 7, preferably a USB interface connected to the personal computer of user K (programming the box). The personal computer previously also served for the Internet ordering process. By means of coded order information 9, reception apparatus 1 is made reception-ready as previously described. This order information 9 can thus be transferred from the PC via interface 15 to memory element 8. Input of the information via input means 6 is also possible. Thereafter, the reception/provision apparatus operates autonomously, i.e., without connection to the user's PC or the Internet.

Following the storage of coded order information 9 in memory element 8, container 2 with control unit 18, or control unit 18, or only the part of the control unit containing memory element 8, or only the memory element is brought outside in front of the residence or place of business to construction element 12 constructed for instance as a pole and hung up there or connected to container 2. Container 2 is or will be connected to the pole or the retaining element 17*a*, 17*b* via locking elements 14 (preparation of the box). After the locking [of the box], door 3 is closed.

Figure 3A:
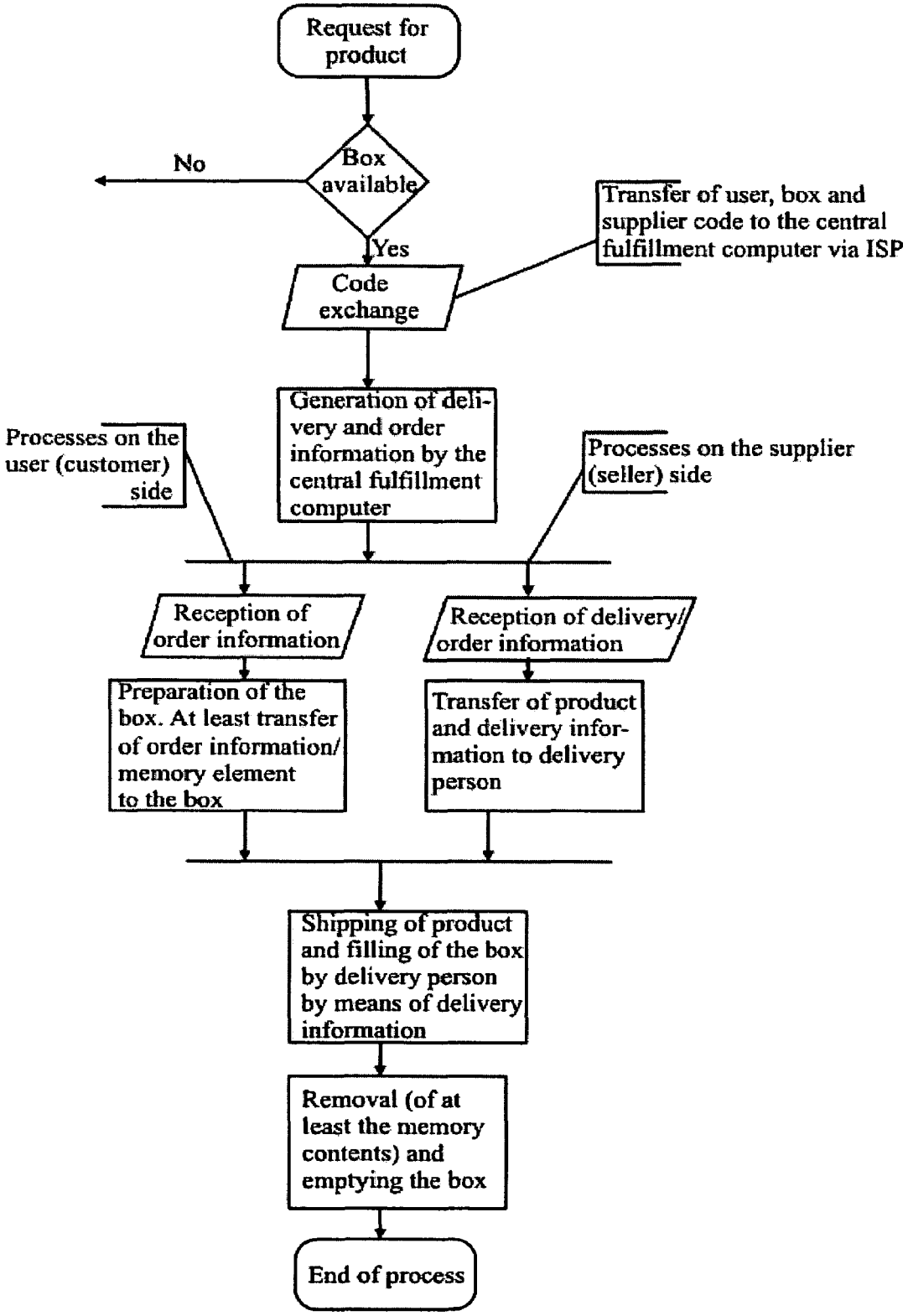
FIGS. 3*a–c,* a flow chart regarding a request process (FIG. 3*a*), a return process (3*b*) and a purchase process (3*c*)

As a first embodiment, FIG. 3*a* shows the sequence of events in the request for and delivery of products by means of the reception apparatus in detail. In case the user (customer) of the supplier (dealer) has a reception apparatus available, the relevant information (possibly also information on the product to be delivered, to take into account nature of the reception apparatus) is exchanged, particularly in order to identify the user and his box. After an authorization query at the central fulfillment computer, order information unique to this order process that has been generated by the central fulfillment computer ZA and with which the memory element of the reception apparatus is made ready for the receipt of this delivery is transmitted to the user. The dealer receives matching delivery information unique to this order process that has been generated by the central fulfillment computer ZA and is to be placed on the delivery (product/package/label). After preparation of the reception apparatus by the user and shipping of the product, the reception apparatus can be filled with the [aid of] the information located on the shipment. This is done by a delivery person.

When the delivery person arrives with the ordered product shipment at reception/provision apparatus 1 hung in front of the recipients residence or place of business, door 3 of container 2 of reception apparatus 1 is closed. Then the delivery person uses input means 6 to input coded delivery information 10 known to him into reception apparatus 1. If coded delivery information 10 agrees with coded order information 9 from memory element 8, or complements it in a predetermined manner, door lock 5 is unlatched and the delivery person can set product 11 in container 2 and then close door 3 (filling the box). It is provided in particular that door 3 is under initial spring tension, so that it closes automatically and cannot remain open. Preferably, coded information 10 is implemented as a label adhered to product 11 that contains a bar code. Accordingly, input device 6 is constructed as a scanner for reading coded delivery information 10. Subsequently, container 2 is opened by the user by, for instance, inputting his master key, removed from retaining elements 17*a, b* and emptied inside his residence or place of business (emptying the box).

As an economical alternative one can consider implementing the memory element also as a label that carries order information 9 as, for instance, a bar code and is placed behind a window of container 2 by the user such that it is visible to the delivery person. The delivery person then carries a scanner, into which he reads the order information and the delivery information. If the two can be made to match in a predetermined manner, then the scanner can switch the door open for container 2.

After filling of the box by the delivery person, the product can be removed by the owner of the reception apparatus and the reception apparatus, or at least the memory elements of the reception apparatus or the memory contents can be removed.

Figure 3B:
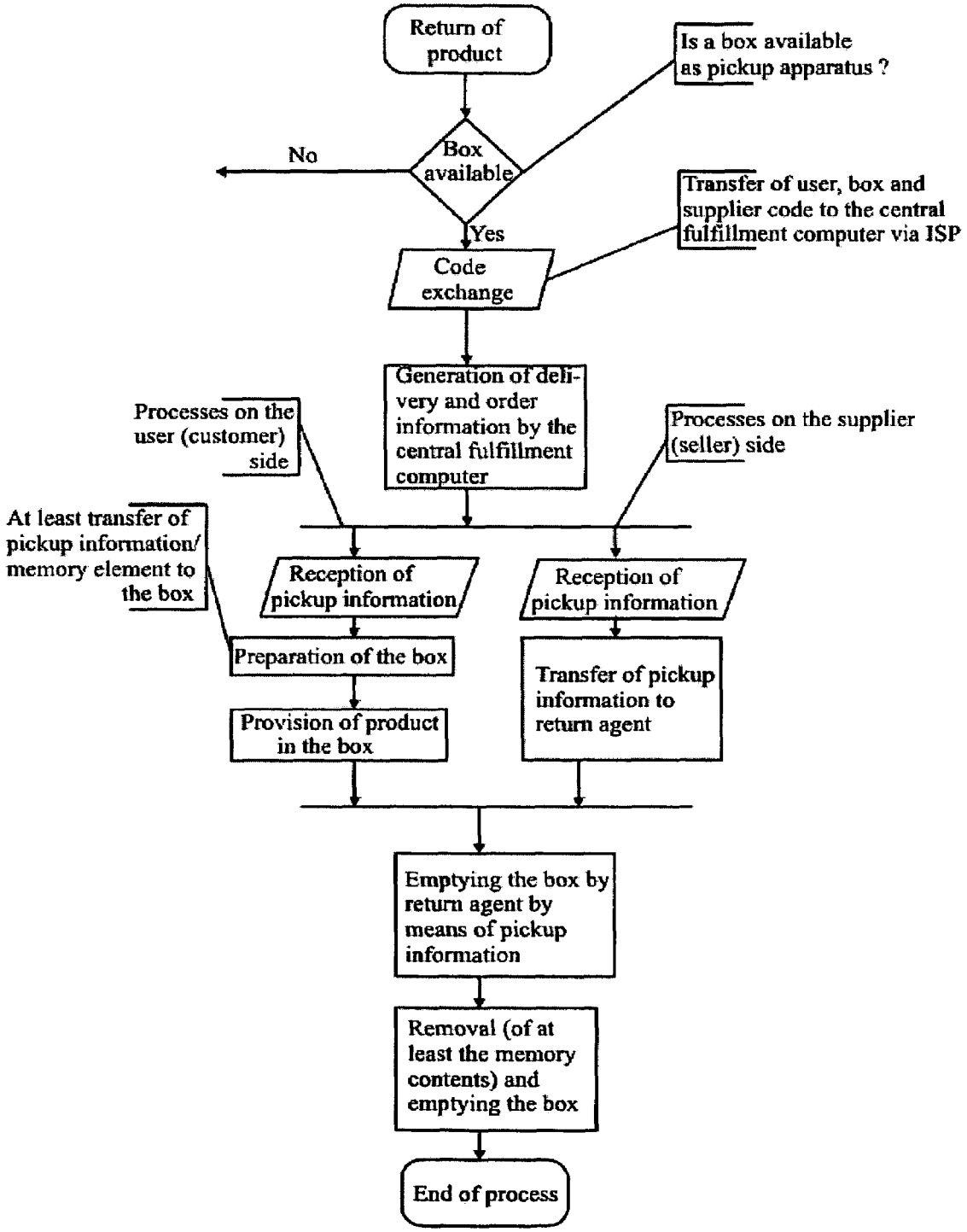

FIG. 3*b* shows, as a second embodiment, the process of a return to the supplier. The user initiates a return delivery with the supplier by harmonizing information on the reception apparatus and the shipment with the central fulfillment computer. Based on this information, the latter generates unique ship/pickup information, with which the user's reception apparatus is programmed. The supplier, for instance, receives the same pickup information, which may also contain information on the reception apparatus. With this pickup information and the site information for the reception apparatus, the supplier authorizes a return agent to pick up the product. The return agent opens the reception apparatus by means of pickup information and ships the product back to the supplier. After emptying by the return agent, the box, or at least the memory contents of the box, can be removed. Alternatively, the user can send the product to a selected recipient in the same manner.

Figure 3C:
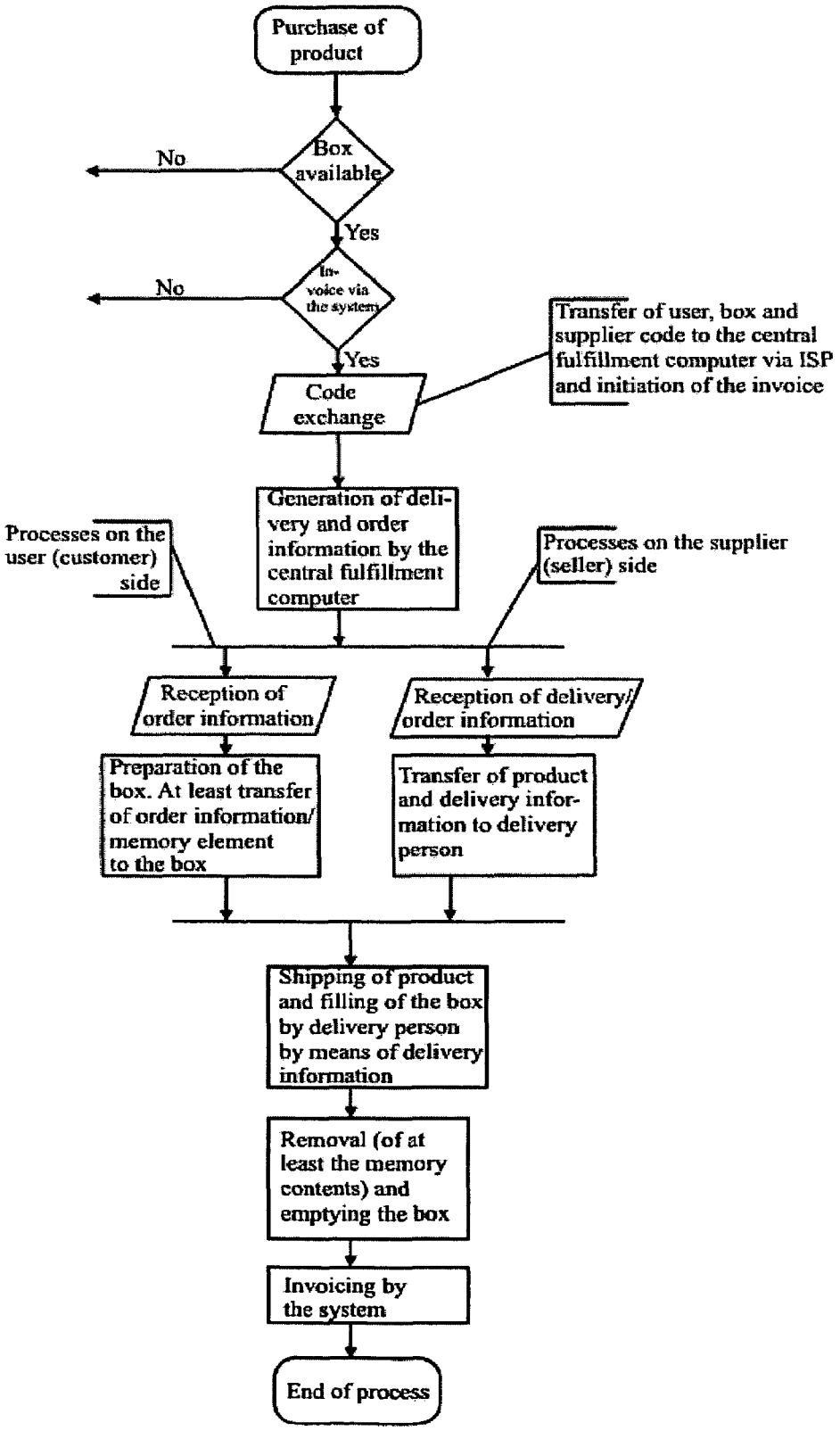

As a third embodiment, FIG. 3*c* shows a process of requesting and delivering products already described in FIG. 3*a,* but now expanded by the component of the payment transaction. In case the user wishes to pay with the aid of the central fulfillment computer, he arranges this manner of payment with the supplier. By virtue of the unambiguous identification of all participants in the system by the central fulfillment computer, the handling of billing can now be initiated. The information relevant for invoicing and payment is transferred to the fulfillment computer. The supplier, for instance, communicates to the central fulfillment computer his requirements for having the invoice be handled by, for him, and external system. The user communicates, for instance, his bank account information to the central fulfillment computer. The shipping of the product and the preparation and provision of the reception apparatus are done as already described for FIG. 3*a.* After delivery, the receipt of the product is acknowledged by the user by communicating, via an appropriate communications channel, the information on the receipt of the product to the central fulfillment computer, with the aid, for instance, of the memory element of the reception apparatus.

Figure 4:
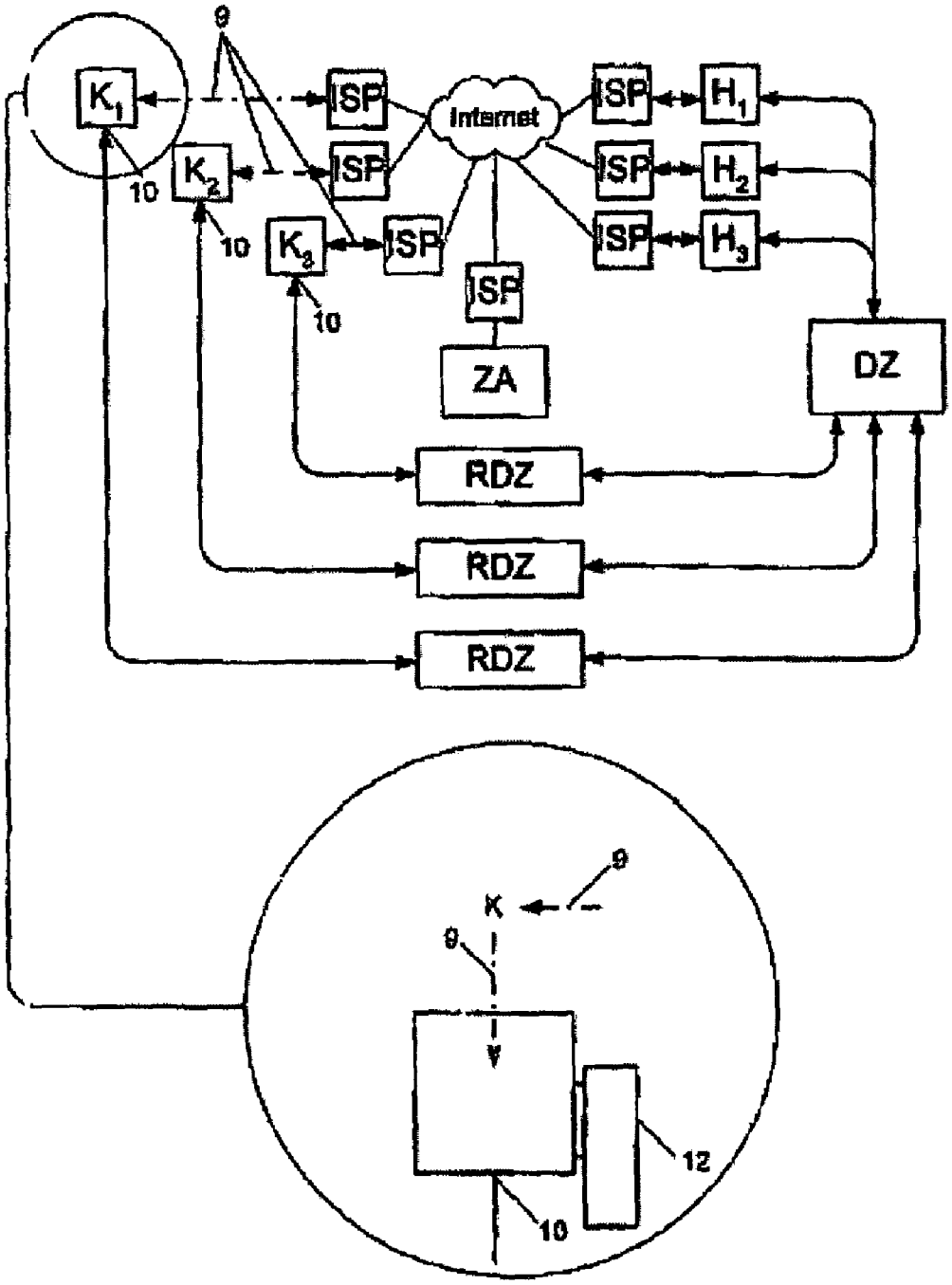
FIG. 4, a diagram showing the product and information flow.

For the sake of completeness, the environment of an ordering process is once again explained in summary form on the basis of FIG. 4, which shows a diagram relating to the products and information during an order. A user K with a reception apparatus 1 of the previously described type orders a given product from supplier H1, . . . via a central fulfillment computer ZA, preferably via an Internet service provider ISP after communicating his own identification code to his reception/provision apparatus 1 and, with the confirmation from the central fulfillment computer, he receives order information 9 unique to this order process. Dealer H supplies the ordered product via the appropriate distribution centers DZ and regional distribution centers RDZ to recipient K. To open reception/provision apparatus 1, the delivery person uses delivery/pickup information 10 communicated to him via his Internet service provider.

LIST OF REFERENCE NUMBERS

1 Reception apparatus
2 Container
3 Door
4 Door handle
5 Door lock
6 Input device
7 Controller
8 Memory element
9 Order information
10 Delivery/pickup information
11 Product
12 Mount
13 Ground
14 Locking element
15 Interface
16 Power supply
17*a, b* Retaining elements
18 Control unit
19 Carrying handle
20*a, b* Opening
ZA Central fulfillment computer
H Dealer
DZ Distribution center
RDZ Regional distribution center
K Customer with box
ISP Internet service provider

The invention claimed is:

1. Apparatus for receiving ordered products and/or making products available for pickup without personal transfer to or by the user of the product, said apparatus comprising:
- a lockable container,
- at least one input device, arranged on or in the container for inputting delivery/pickup information from or to the delivery person or return agent, respectively,
- a control unit arranged in or on the container,
- a removable, transportable memory element adapted to store order information, wherein the container is opened if the delivery/pickup information agrees in a predetermined way with the order information,
- wherein, for an expected delivery/pickup, the memory element or a part of the control unit containing the memory element is adapted to be inserted by the user in the container when the container is positioned in front of the user's residence or place of business in an off-line mode.

2. Apparatus according to claim 1, wherein the container and control unit constitute a constructive unit.

3. Apparatus according to claim 2, further comprising a door adapted to be locked and unlocked by means of a door lock that is arranged on the container, wherein said door lock is electrically operated by the control unit.

4. Apparatus according to claim 2, wherein the control unit comprises an interface for inputting order information into the memory element.

5. Apparatus according to claim 2, further comprising a power source located in the container and by which the control unit is supplied with electrical power.

6. Apparatus according to claim 2, wherein said input device comprises a laser scanner for reading in bar code information.

7. Apparatus according to claim 1, wherein the container comprises fastening elements by means of which the container is adapted to be fastened to a stationary construction element arranged in front of or on the outside wall of the user's residence or place of business.

8. Apparatus according to claim 7, wherein the fastening elements are locked and unlocked from an interior of the container.

9. Apparatus according to claim 7, further comprising a carrying element arranged on the outside of the container.

10. Apparatus according to claim 7, further comprising rollers arranged on an outside of the container.

11. Apparatus according to claim 1, further comprising a door adapted to be locked and unlocked by means of a door lock that is arranged on the container, wherein said door lock is electrically operated by the control unit.

12. Apparatus according to claim 11, wherein the control unit comprises an interface for inputting order information into the memory element.

13. Apparatus according to claim 12, further comprising a power source located in the container and by which the control unit is supplied with electrical power.

14. Apparatus according to claim 13, wherein said input device comprises a laser scanner for reading in bar code information.

15. Apparatus according to claim 11, further comprising a power source located in the container and by which the control unit is supplied with electrical power.

16. Apparatus according to claim 11, wherein said input device comprises a laser scanner for reading in bar code information.

17. Apparatus according to claim 1, further comprising a power source located in the container and by which the control unit is supplied with electrical power.

18. Apparatus according to claim 1, further comprising a carrying element arranged on the outside of the container.

19. Apparatus according to claim 1, further comprising rollers arranged on an outside of the container.

20. Apparatus according to claim 1, wherein said input device comprises a laser scanner for reading in bar code information.

21. Apparatus according to claim 1, further comprising at least one interface between the container and the memory element.

22. Apparatus for receiving ordered products and/or making products available for pickup without personal transfer to or by the user of the product, said apparatus comprising:

a lockable container comprising fastening elements by means of which the container is adapted to be fastened to a stationary construction element outside the user's residence or place of business, at least one input device, arranged on or in the container for inputting delivery/pickup information from or to the delivery person or return agent, respectively, a control unit arranged in or on the container, a removable, transportable memory element adapted to store order information, wherein the container is opened if the delivery/pickup information agrees in a predetermined way with the order information, wherein, for an expected delivery/pickup, the memory element or a part of the control unit containing the memory element is adapted to be inserted by the user in the container when the container is positioned in front of the user's residence or place of business in an off-line mode; and, wherein the stationary construction element is constructed as a post anchored in the ground, on which the container is adapted to be hung, and retaining elements are arranged on the construction element for engaging the container, said apparatus further comprising a locking element for engagement with at least one of the retaining elements.

23. Apparatus according to claim 22, wherein the fastening elements are locked and unlocked from an interior of the container.

24. Apparatus for receiving ordered products and/or making products available for pickup without personal transfer to or by the user of the product, said apparatus comprising:

a lockable container, at least one input device, arranged on or in the container for inputting delivery/pickup information from or to the delivery person or return agent, respectively, a control unit arranged in or on the container, a removable, transporatable memory element adapted to store order information, wherein the container is opened if the delivery/pickup information agrees in a predetermined way with the order information, wherein, for an expected delivery/pickup, the memory element or a part of the control unit containing the memory element is adapted to be inserted by the user in the container when the container is positioned in front of the user's residence or place of business in an off-line mode; and, the control unit comprising an interface for inputting the order information into the memory element.

25. Apparatus according to claim 24, further comprising a power source located in the container and by which the control unit is supplied with electrical power.

26. Apparatus according to claim 24, wherein said input device comprises a laser scanner for reading in bar code information.

* * * * *